US008025065B2

(12) United States Patent
Guliker

(10) Patent No.: US 8,025,065 B2
(45) Date of Patent: Sep. 27, 2011

(54) FAST APPLICABLE HAIR PIECE PROVIDED WITH A WEAVING BAND COMPLETELY INTEGRATED WITH BASIC HAIR AND METHOD FOR ATTACHING THEREOF

(75) Inventor: Richard Guliker, Schipluiden (NL)

(73) Assignee: Euro Hair R&D B.V., EA Schipluiden (NL)

( * ) Notice: Subject to any disclaimer, the term of this patent is extended or adjusted under 35 U.S.C. 154(b) by 957 days.

(21) Appl. No.: 10/578,163

(22) PCT Filed: Nov. 8, 2004

(86) PCT No.: PCT/NL2004/000786

§ 371 (c)(1),
(2), (4) Date: Feb. 15, 2007

(87) PCT Pub. No.: WO2005/044031

PCT Pub. Date: May 19, 2005

(65) Prior Publication Data

US 2007/0125399 A1 Jun. 7, 2007

(30) Foreign Application Priority Data

Nov. 7, 2003 (NL) ..... 1024734

(51) Int. Cl.
*A41G 3/00* (2006.01)

(52) U.S. Cl. ..... 132/201; 132/53

(58) Field of Classification Search ..... 132/201, 132/53–56

See application file for complete search history.

(56) References Cited

U.S. PATENT DOCUMENTS

| | | | | |
|---|---|---|---|---|
| 3,280,826 | A | 10/1966 | Jenkins | |
| 5,121,761 | A | 6/1992 | Meister | |
| 5,357,986 | A * | 10/1994 | Hargrett | 132/201 |
| 5,979,462 | A * | 11/1999 | Jones | 132/54 |
| 7,469,701 | B1 * | 12/2008 | Bernard | 132/201 |
| 2001/0035192 | A1 | 11/2001 | Townsend | |
| 2005/0061346 | A1 * | 3/2005 | Song | 132/201 |
| 2005/0268928 | A1 * | 12/2005 | Lane | 132/53 |

FOREIGN PATENT DOCUMENTS

| | | |
|---|---|---|
| DE | 201 07 344 U1 | 9/2001 |
| FR | 2 897 241 A | 8/2007 |
| NL | 1 022 306 C1 | 7/2004 |

* cited by examiner

*Primary Examiner* — Rachel Steitz

(74) *Attorney, Agent, or Firm* — Knobbe, Martens, Olson & Bear, LLP

(57) ABSTRACT

The invention relates to a fast applicable hair piece (1) for obtaining a special esthetical effect like e.g. a colour effect or a hair volume effect having a remarkable high wearing comfort for the user. The hair piece (1) comprises at least one thin, broad and flat hair piece (3) consisting of a number of hairs (20). The hair bundle (3, 3', 3") is provided at its free end with a lightweight and thin elongated weaving band (2, 2', 2") made from hair or from another suitable material like e.g. cotton or a synthetic material comprising regularly weaving elements (11). This weaving band is characterized by connection opening (4, 4', 4", 31) provided at regular mutual distance. A suitable number of basic hairs (9, 9', 9") may be passed through said connection openings (4, 4', 4", 31). As a result a temporarily, durable however eventually easily removable connection between the hair (1) piece and the basic hair (6) will be formed, in such a way that the hair piece (1) is always reusable. Furthermore the invention relates to a method for attaching a hair piece (1).

13 Claims, 9 Drawing Sheets

FAST APPLICABLE HAIR PIECE PROVIDED WITH A WEAVING BAND COMPLETELY INTEGRATED WITH BASIC HAIR AND METHOD FOR ATTACHING THEREOF

BACKGROUND OF THE INVENTION

1. Field of the Invention

The invention relates to a fast applicable hair piece for obtaining a special esthetical effect like e.g. a colour effect or a hair volume effect. The hair piece comprises at least one thin, broad and flat hair piece consisting of parallelley oriented hairs, and a lightweight and thin elongated weaving band comprising regular weaving elements made from hair or from another suitable material like e.g. cotton or a synthetic material such that the hair piece may be completely integrated with the basic hair and is easily removable, having a remarkable high wearing comfort for the user. Furthermore the invention relates to a method for attaching the fast applicable hair piece.

2. Description of the Related Art

Hair pieces used in modern hair fashion and hair cosmetics are applied for hair extension or for hair shaping, but also for obtaining a special esthetical effect like e.g. a colour effect, volume effect etc. Hair pieces usually made from artificial hair or natural hair must meet many different requirements. These hair pieces must be easily attachable and also be easily removable and also must provide high wearing comfort to the user. Furthermore the hair pieces must be shape retaining, durable ad weatherproof and also shampoo etc. resistant. It is known to shape a modern hair piece as a relatively thin, broad and flat hair bundle which at the position of the first free end (hair tops) is provided transversely with a known weaving band, firstly for mutual interconnection of the hairs and secondly for obtaining a surface for interconnection with the basic hair. Moreover the weaving band may be made from natural or artificial hair, but also from a strip/sheet shaped flexible plastic strip. Such a hair piece with weaving band which may be easily connected and removed from the basic hair or natural hair of a person is also called a weft. Such a hair piece is attached to the basic hair by conducting a number of basic hairs or a knot of hair through openings in the weaving band and interconnecting these knots of hairs. These openings are provided between the weaving elements connected to the hairs of the hair bundle.

The disadvantage of this type of hair piece with weaving band is that the interconnected knots of basic hair will remain visible because mixing of the hairs of the hair piece with the basic hair is difficult, so that it is easily remarked by other people that a hair piece is used. Camouflaging of the weaving band and the interconnected knots of basic hair is possible, but is labour-intensive and therefore expensive.

SUMMARY OF THE INVENTION

The object of the invention is to provide a hair piece that is easily, reliably and fastly connectable with basic hair, whereby the weaving band and the knots of basic hair are hardly visible.

According to the invention the hair piece for connection with basic hair comprises the following elements:

- at least one thin, broad and flat hair bundle consisting of a number of parallelly oriented hairs,
- a lightweight and thin elongated weaving band connected to the outer end of each hair bundle whereby the band is provided with a number of weaving elements made from hair or another suitable material, like cotton or a synthetic material, and whereby each of the hairs of the hair bundle is interconnected individually or in groups with the weaving elements of the weaving band,
- connection openings,
- connection elements each provided at a regular mutual distance between the weaving band(s) of the hair bundle(s).

Such a hair piece may be easily connected with the basic hair, whereby the weaving band and the knots of basic hair connected therewith are hidden from view during use, because they are located between both hair bundles. Moreover two hair bundles may be attached into the basic hair whereby connections must only once be made with the basic hair. A suitable number of basic hairs may be passed through said connection openings and subsequently interconnected by means of a suitable method by using adhesion/adhesive means, but also by means of braiding, knotting, rolling or the like. As a result a temporary, durable, however eventually easily removable connection between the hair piece and the basic hair will be formed, in such a way that the hair piece is reusable and at the same time it offers a remarkable high wearing comfort to the user.

Particularly, connection openings are being provided between the weaving elements, and preferably the connection openings are being formed by weaving band loops or by joined weaving elements. Advantageously by adding a second hair bundle to the well know hair piece consisting of one hair bundle provided with connection openings in the waving band, a new hair piece is obtained comprising two hair bundles which may be economically and easily attached into the basic hair.

In a special embodiment the connection openings are formed by the free space which is present between the connected weaving band(s). This embodiment can be economically and easily made because of the connection elements now formed between the interconnected weaving band(s) making the provision of connection element into the weaving band not necessary.

Particularly the hair piece is provided with one weaving band being connected with two hair bundles, whereby the weaving band is basically shaped as a closed loop. Preferably the head ends of a piece of weaving band are interconnected thereby forming a closed loop. By connecting the head ends of a single piece of weaving band and giving the band the shape of a closed loop the hair piece may be manufactured more easily and economically.

Particularly the head ends of the piece of weaving band are abuttingly positioned with respect to each other without overlapping each other. Preferably the head ends of the piece of weaving band are interconnected by means of a stitched seam extending transversely over both weaving band ends. By these measures the wearing comfort is not decreased because of thickening of the band and also releasing, hanging open or fraying of the head ends is prevented.

In a particular embodiment the hair piece comprises two hair bundles whereby the first hair bundle is connected to a first weaving band and that the second hair bundle is connected to a second weaving band. In an equivalent way the hair piece according to the invention is obtained by connecting two single hair bundles by means of connection elements.

In a different embodiment of the invention the hair piece is configured by a number of small weaving bands each provided with hair bundles, shaped as a closed loop, whereby the small weaving bands are mutually connected (mutually transversely interconnected).

Particularly the weaving bands of the hair bundles are interconnected with their upper sides, in other words, with the sides opposite of the hair bundle, by means of connection elements provided transversely at a regular distance. Preferably the upper sides of the weaving bands are transversely abuttingly positioned with respect to each other. By only interconnecting the upper sides of the weaving bands the hair piece may be easily unfolded for connection into basic hair and subsequently easily folded up. By positioning the upper sides abuttingly close to each other only short simple connection elements need to be fixed between the weaving band(s).

In another embodiment two connection elements are repeatedly provided at a short distance with respect to each other. This gives the advantage that a hair piece may be shortened by cutting the weaving band between both neighbouring connection elements so that two hair pieces are obtained which have non fraying not open hanging weaving bands.

Particularly the hair bundle consists of small groups of hairs provided with interspaces having little or no hair. Preferably groups of hairs have a lateral dimension (a) between about 2 and 4 mm, the interspaces (22) having a lateral dimension (b) between about 0.5 and 3 mm. In this way the basic hair and the hair.

In a particular embodiment the hair piece is laterally provided on both sides of one or more groups of hairs with less hair or hair volume. The wearing comfort is increased and especially the visibility of the closed loop embodiment is decreased because in the basic hair a local concentration of hair originating from the hair piece is prevented.

In another embodiment the hair bundles are each provided with hairs of different length and/or colour or hue. Preferably the difference in length between the hairs of the hair bundles varies between about 2 and 12 cm. With these measures a natural integration of the hair piece into the basic hair is obtained in particular by applying on top of each other hair bundles of different length.

The invention also relates to a method for attaching a hair piece into basic hair comprising the following steps:

a) unfolding the hair piece principally in a flat plane in such a way that the free ends of the hair bundles being connected with the weaving band(s) are extending in an opposite direction with respect to each other,
b) positioning of the mutually interconnected weaving band(s) of the hair bundles in close vicinity of the basic hair, whereby the hair bundles are remaining to extend in an opposite direction,
c) conducting at least one time a number of basic hairs (knot of hair) through a connection opening of the hair piece,
e) interconnecting the passed through knot of basic hair with the weaving band or with another knot of basic hair by means of other means while using a method known per se,
f) repeating the steps c) till e) for another connection opening located in or between the weaving band(s) until the hair piece is sufficiently fixedly connected with the basic hair along the length of the weaving band.

By connecting the hair piece in a folded open position with the basic hair and subsequently folding up the hair piece, a thorough mixing is obtained between the hair of the hair piece and the basic hair, whereby the parts that should not be visible like e.g. the interconnected knots of basic hair are hidden between the hair bundles of the hair piece.

Particularly the method known per se for connecting joint basic hairs comprises the following steps:

positioning of an adhesion piece onto the joint basic hairs which piece in cross-section is shaped as a straight and/or diverging C,I,L or U-shaped profile or the like, either provided or not with interior or exterior ribs, fixedly interconnecting the adhesion piece with the joint hairs by application of a method known per se like compressing together or shrinking, either with or without using a suitable means and/or by the application of heat Preferably the adhesion piece is attached onto basic hair by means of a thin sheet-shaped hull, made e.g. from aluminium foil, at a suitable distance from the weaving band like e.g. 2-3 cm. In this way the hair piece may be fast attached into the hair of a person and also be removed quickly. As a result a durable and easlily removable connection of the hair piece with the basic hair will be formed in such a way that the hair piece may be reused.

The special design of said adhesion element and also the device is related to an invention described in Dutch patent application nr. 1021900—"Herbruikbaar haarverlengstuk en inrichting en werkwijze voor het gebruiken ervan [Reusable hair extension and method for use thereof]" of the applicant.

The invention with now be descried by means of an embodiment shown in of the drawings.

DETAILED DESCRIPTION OF THE PREFERRED EMBODIMENT

Figure 1:
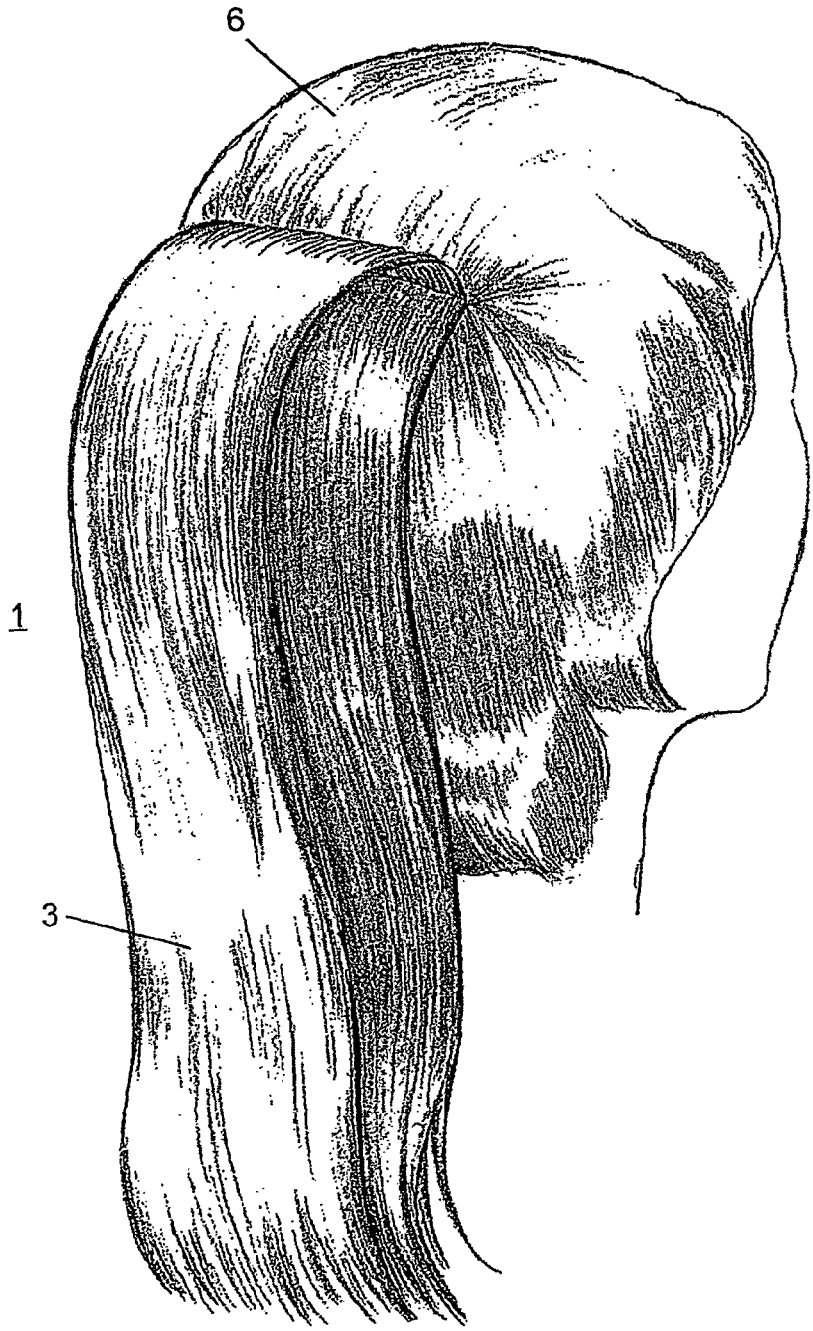
FIG. 1 shows the back of the head of a person with a hair piece attached into the hairstyle, according to the invention.

In FIG. 1 is shown in detail how hair piece 1 according to the invention is connected in basic hair 6 of the hairstyle of a person, in such a way that the hair bundles 3 are configured as a hair extension like a tail.

Figure 2:
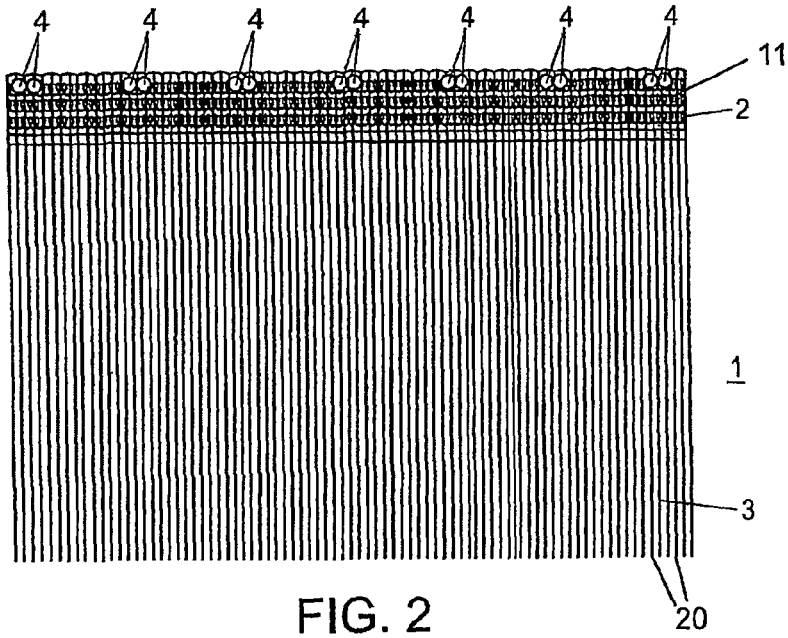
FIG. 2 shows a view of a known hair piece with openings between the weaving elements.

In FIG. 2 is shown a known hair piece 1 with hair bundle 3 consisting of a number of parrallelly oriented hairs 20. These hairs are connected with weaving band 2, e.g. by means of weaving elements 11. In the weaving band 2 between the weaving elements 11, transversely at regular mutual distance of e.g. 2 cm, are attached a number of but also a set or groups (e.g. 2, 3 or 4) of substantially large recesses or connection openings 4. The openings 4 are configured between the weaving elements 11 connected with the hairs of the hair bundle 3, but they also may be configured by joining together of weaving elements.

Moreover a suitable amount of basic hairs may be conducted through said connection openings 4 and mutually interconnected on the back side of the weaving band 2 by means of a suitable method by using adhesive means, but also by means of a braiding, knotting, rolling or the like. As a result a temporary, durable however eventually easily removable connection between the hair piece and the basic hair will be formed, in such way that the hair piece is reusable and it offers at the same time a remarkable high wearing comfort to the user.

Figure 3:
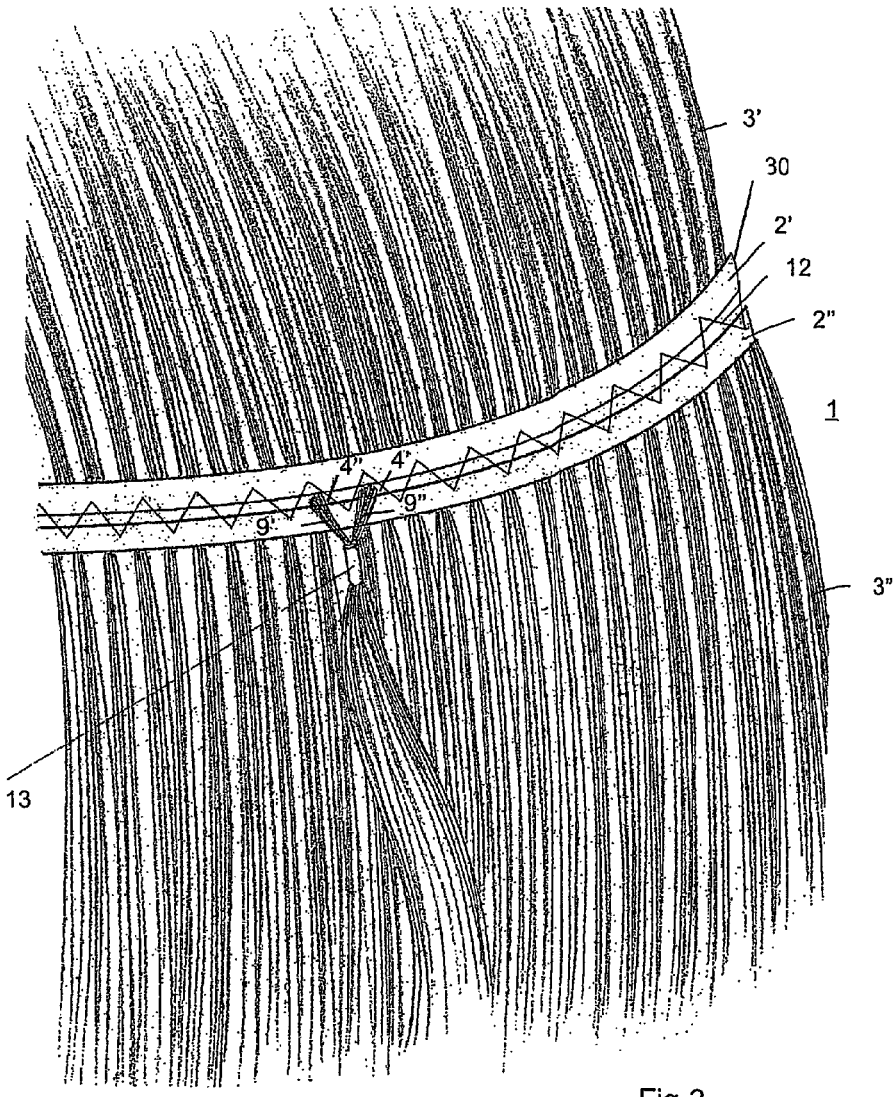
FIG. 3 shows a perspective view of the hair piece according to the invention.

In FIG. 3 is shown the fast applicable hair piece 1 according to the invention, comprising two broad hair bundles (strips of hair) 3' and 3" each on the upper side provided with a weaving band 2', 2" connecting the free upper ends of all the hairs of the hair bundles into a compact unit. The hair piece 1 is shown in unfolded state with first hair bundle 3' connected with first weaving band 2' and second hair bundle 3" connected with second weaving band 2". Both weaving bands 2', 2" are mutually interconnected by means of connection elements 12; in this example configured as 'zigzag' mounted connection cords. Openings 4' and 4" are formed by the free space available between the connection elements 12 and the upper side of the weaving bands 2' and 2". Two knots of basic hair 9', 9" are conducted through two adjacent connection openings 4' and 4" and interconnected at a suitable distance of e.g. 2-3 cm from the openings 4', 4" by means of a suitable hair connection means 13, like a clamping element. Furthermore when needed once more knots of basic hair 9', 9" may be conducted through another free connection opening 4', 4" formed between the weaving elements 2', 2" and mutually interconnected to each other in order to fixedly and firmly connect the hair piece 1 with the basic hair.

If desired a knot of passed through basic hair 9', 9" may be connected with weaving band 2', 2" of hair bundle 3', 3" for example at the outer end or head end 30 of the hair piece 1 when no second knot of basic hair is available for connecting. As hair connection means 13 may be used an adhesion element manufactured from adhesion means at a suitable distance of e.g. 2-3 cm from the weaving band 2". This adhesion element may be shaped in cross-section as a straight or diverging C, I, L, U profile or the like and moreover be provided with interior or exterior ribs for obtaining a greater contact surface for connection with basic hair. A known device comprising e.g. a set of claws while using or not heat may be used for obtaining a compact connection between said adhesion element and said basic hair.

Figure 4:
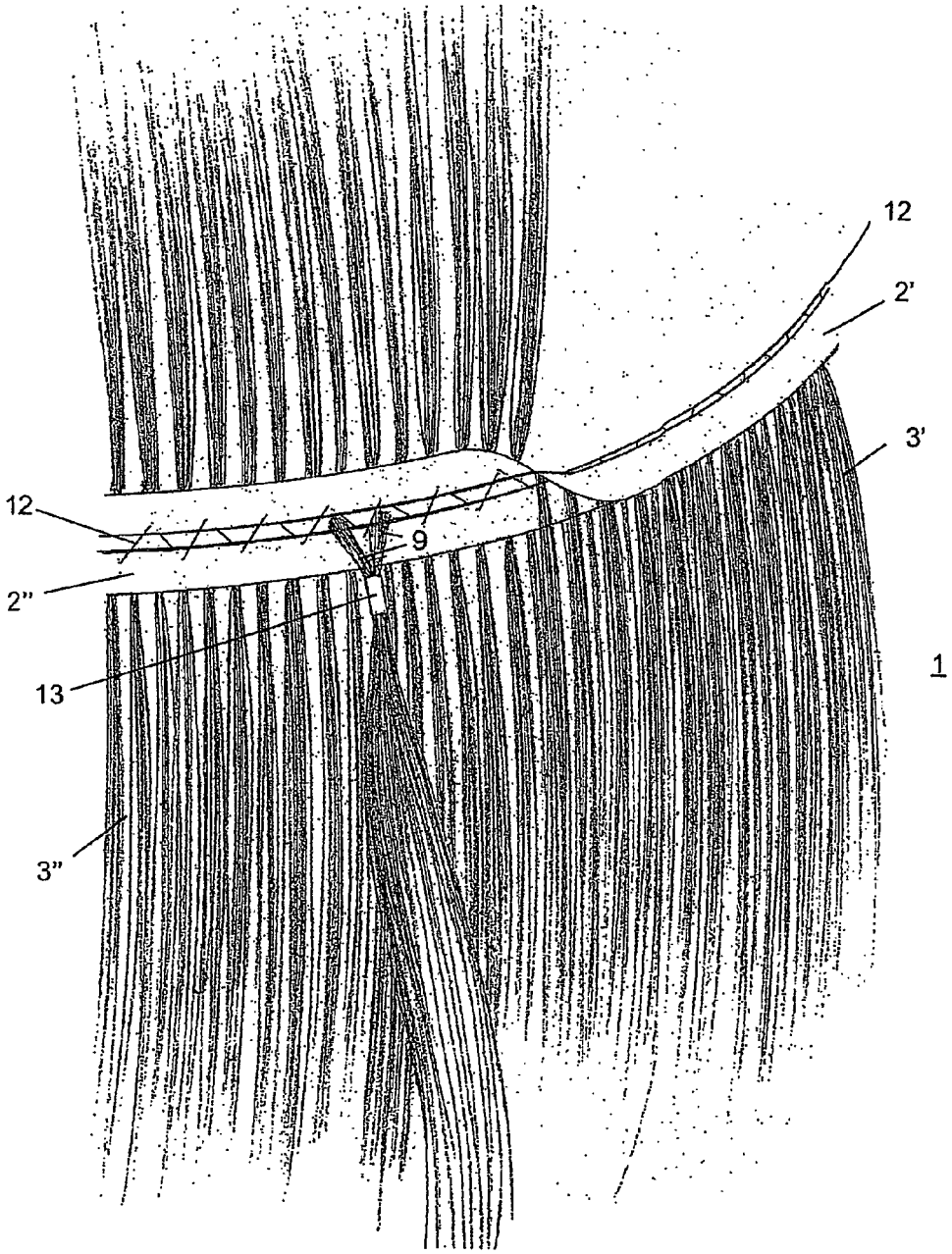
FIG. 4 shows a perspective view of the hair piece, half folded up.

In FIG. 4 is shown that after the hair piece 1 is fixedly connected with the knots of basic hairs 9', 9" the first hair bundle 3' with weaving band 2' is folded back over its flexible folding zone configured by the connection elements 12, so that the interconnected knots of basic hair 9', 9" together with the hair connection means 13 are hardly visible, because they are hidden between the first and the second hair bundle 3' and 3".

Figure 5:
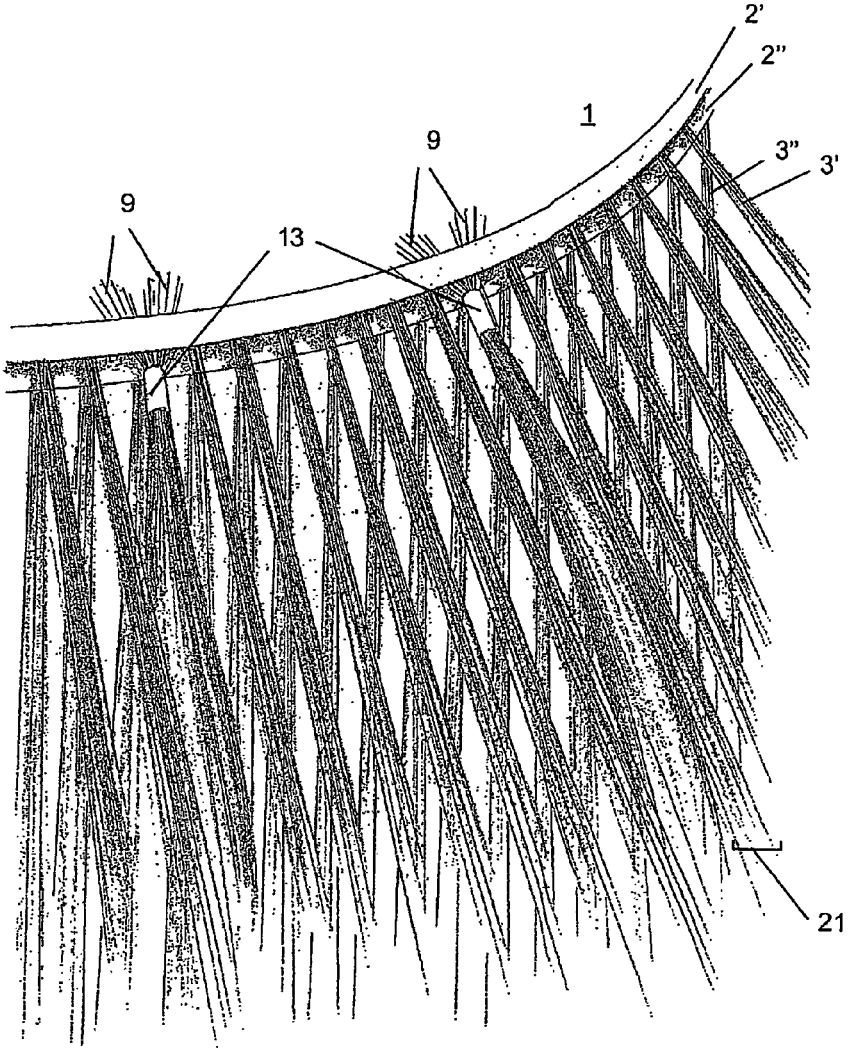
FIG. 5 shows a perspective view of the hair piece, completely folded up.

In FIG. 5 is shown the completely folded up hair piece 1 as it is applied in the basic hair of a person. Hair piece 1 is hanging on the interconnected knots of basic hair 9 which are passed through the connection openings configured between the weaving bands 2', 2". It can be seen clearly, that the groups of hairs 21 are mixing well with the knots of basic hair 9.

Figure 6:
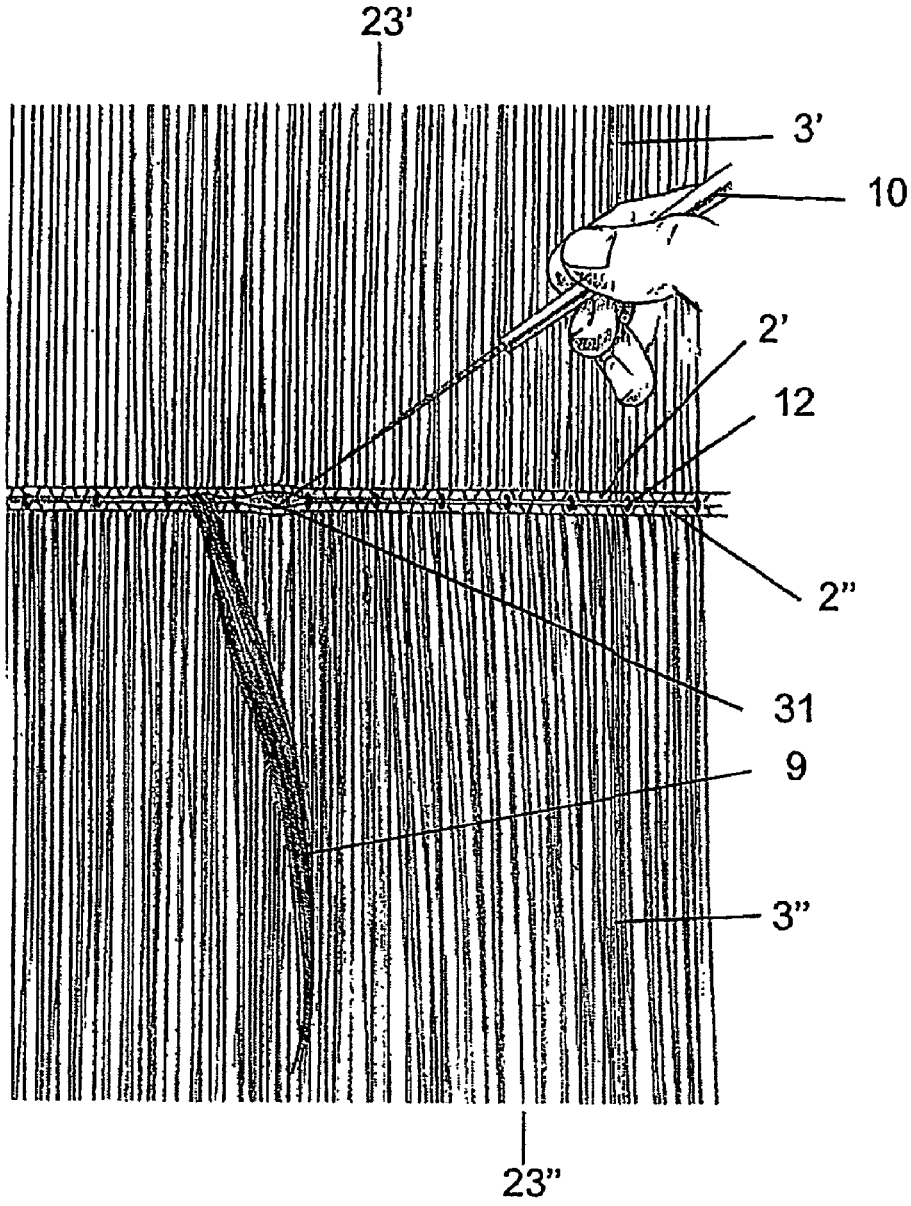
FIG. 6 shows a view of connecting the hair piece by means of a crochet hook.

In FIG. 6 is shown how a knot of basic hair 9 is conducted through connection opening 31 by means of a crochet hook 10. As a result on both sides of connection element 12 a knot of hair is passed through the hair piece 1. In this embodiment the weaving bands 2', 2" of the hair bundles 3', 3" are transversely abbutingly positioned with respect to each other because the connection elements 12 are short e.g. performed as stitch. Preferably the connection elements 12 are provided in the upper side of the weaving bands such that the hair piece 1 may be easily folded upwards or downwards.

Figure 7:
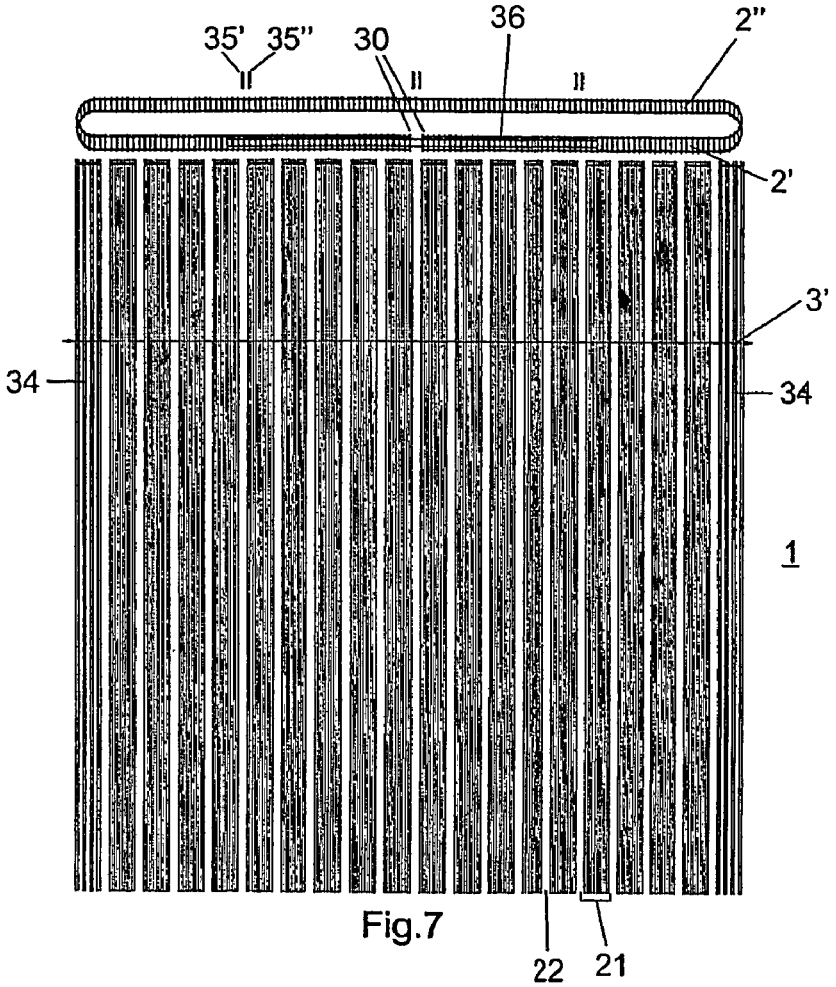
FIG. 7 shows schematically the closed loop embodiment of the hair piece.

FIG. 7 shows schematically an embodiment of the hair piece according to the invention whereby two hair bundles are formed by shaping a piece of weaving band into a closed loop. The outer ends or the head ends 30 of a piece of weaving band are interconnected such that a hair bundle 3' with weaving band is provided and a hair bundle 3" (not shown) with weaving band 2". Preferably the head ends 30 are abuttingly touching each other however without overlapping, so that as a result at the location where the head ends are connected no thickening in the weaving band 2' will occur so that the wearing comfort is not diminished nor is the visibility of the hair piece 1 is increased. The connection between the head ends 30 may be provided with an additional reinforcement by means of an additional stitching seam 36 extending over both weaving band ends.

Furthermore FIG. 7 shows an easily adaptable embodiment of the hair piece on a short distance with respect to each other being provided with connection elements 35' configured between the weaving band (parts) 2', 2". Instead of a single connection element like a stitching seam, double connection element 35', 35" are applied thereby offering the possibility to shorten the hair piece by cutting open the weaving band between the stitched seams 35', 35". As a result two hair pieces 1 are created, the first one with stitching seam 35', the second one with stitching seam 35" so that advantageously the outer ends of the cut open hair piece will not hang open or fray.

Moreover in FIG. 7 is shown the embodiment of hair piece 1 whereby groups of hairs 21, 34 are alternately provided with interspaces 22 with little or no hair. As a result the basic hair will mix very good with the hair of the hair piece 1 so that the visibility of the hair piece is reduced. Preferably the width g of a hair group has a value between 2 and 4 mm and the interspaces b are having a size between 0.5 and 3 mm (See FIG. 8). Furthermore FIG. 7 shows groups of hair 34 having less hair or hair volume. These groups 34 are laterally provided on the outer ends of hair piece 1 so that no thickening will occur locally in the basic hair and also the transition from basic hair to hair piece will be less visible.

Figure 8:
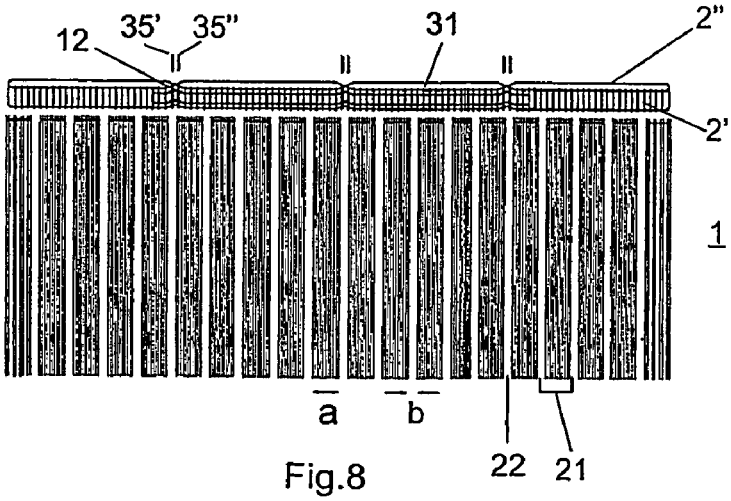
FIG. 8 shows schematically the embodiment of FIG. 7 with connection elements.

FIG. 8 schematically shows how connection elements 12 are attached between both weaving band(s) (parts) 2', 2" by means of two stitching seams 35' and 35". The stitching seams 35' and 35" are provided at the upper side of the weaving band (parts) 2' and 2" so that hair piece 1 may be easily folded up and open up for connection into basic hair. Moreover it shows how the connection opening 31 is formed between connection elements 12, 35 and the weaving band (parts).

Figure 9:
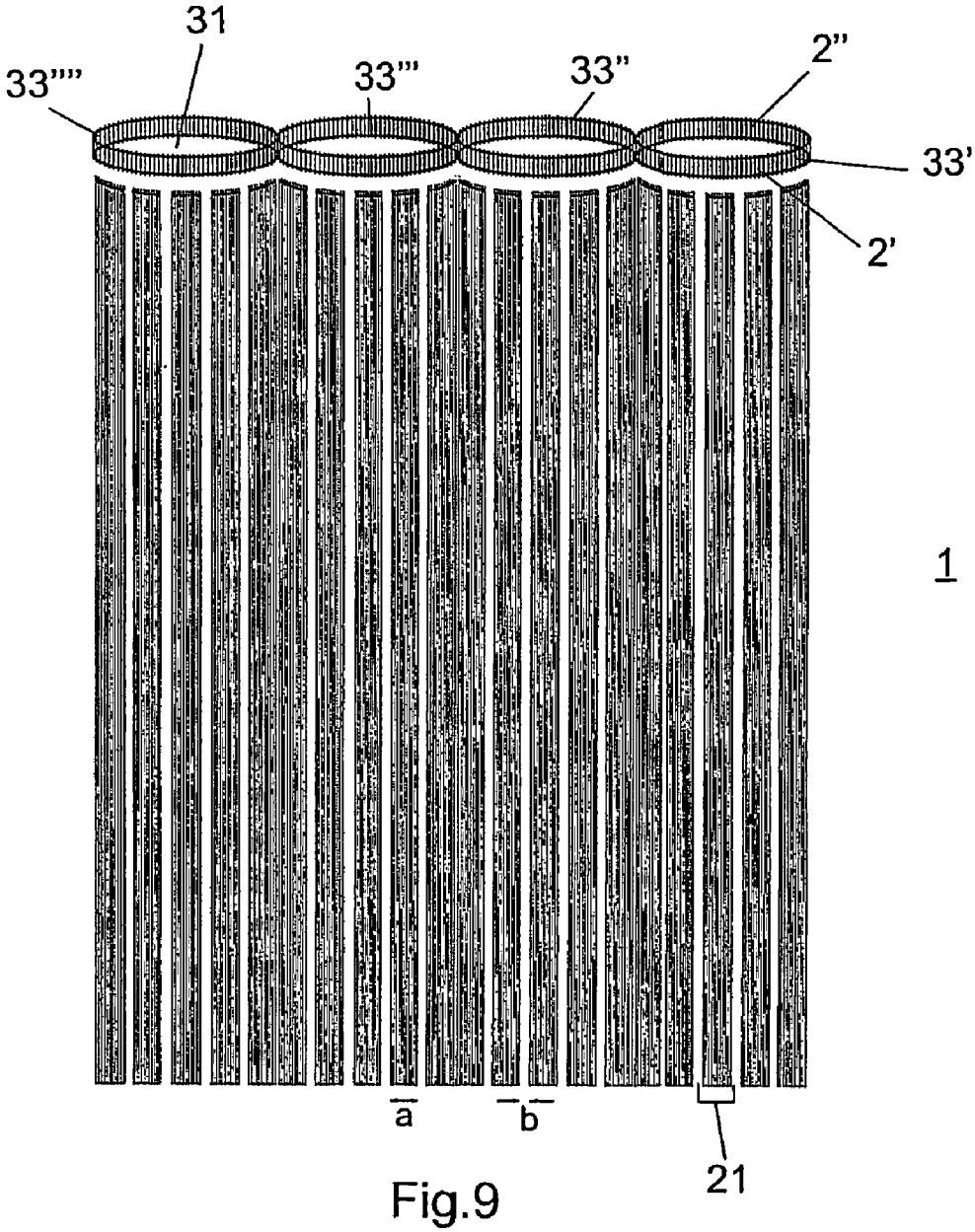
FIG. 9 shows schematically the embodiment with mutually transversely interconnected small closed loops.

FIG. 9 shows a hair piece 1 with two hair bundles and connected therewith weaving bands 2' and 2", whereby the weaving band is configured by small weaving bands 33', 33", 33'", 33" provided with hair bundles. The small weaving bands are mutually transversely interconnected, with their head ends. The connection openings 33 are formed by the openings of the small weaving bands 33 so that as a result no connection elements need to be provided for configuring the connection openings. An intermediate form is also possible, whereby both the small weaving bands are interconnected and also connection elements are provided.

Figure 10:
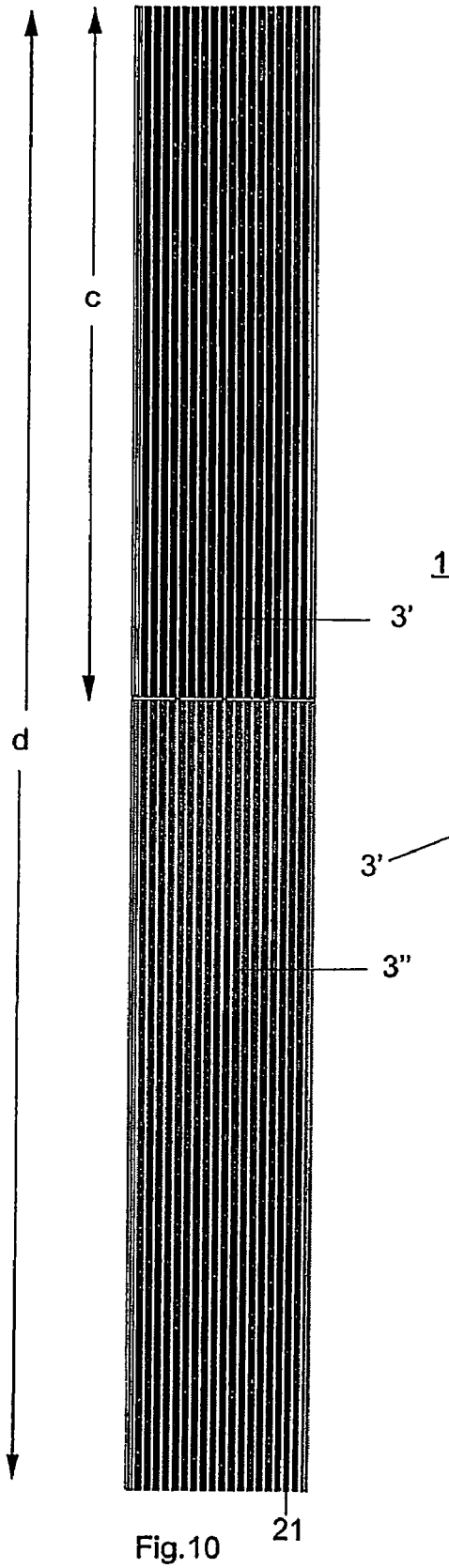
FIG. 10 shows a front view of an embodiment of the hair piece with hair bundles of different length.

FIG. 10 shows an embodiment of the hair piece 1 with hair bundles 3', 3" with different lengths. Lower hair bundle 3" is provided with groups of hair 21 having a greater length then the hairs of hair bundle 3'. The dimension c of hair bundle 3' is e.g. between 2 and 40 cm while the dimension d of hair bundle 3" has a value between 4 and 50 cm such that the difference in length between the hairs of the groups has a value between 2 and 12 cm. It is also possible to vary the length of groups of hairs within a hair bundle or even to vary the length of hairs within a group of hairs.

Figure 11:
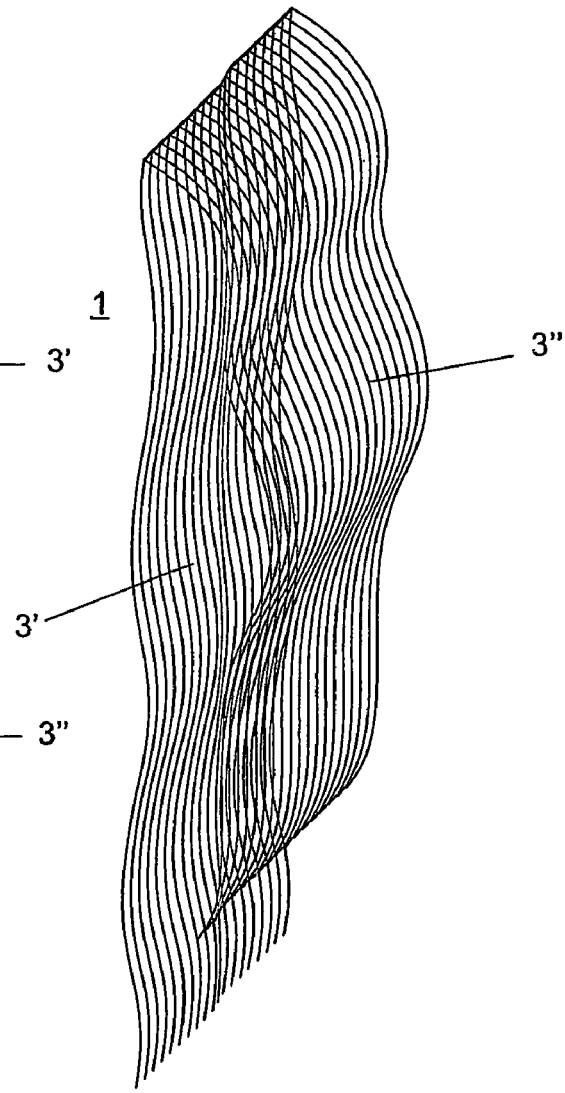
FIG. 11 shows a perspective view of an embodiment with curled hair.

FIG. 11 shows an example of a hair piece 1 provided with hair bundles 3', 3" comprising hairs which are specially wavy or curly. Also hairs, groups of hairs or hair bundles 3', 3" may be provided with a different colour or hue.

Due to the above mentioned measures the hair piece according to the invention may be connected with the basic hair in substantially shorter time, so that the flexural strain and the tension strain and the weaving band respectively are reduced to a minimum.

It will be clear that within the scope of the invention more embodiments are possible so that all technical equivalents known to a person skilled in the art are also considered to be part of the inventive idea.

The method for attaching a hair piece into basic hair according to the invention comprises the following steps:

firstly hair piece 1 is completely unfolded such that the hair bundles are extending in a flat plane. This is done by displacing the free ends 23', 23" of the hair bundles in opposite directions in such a way that the hair bundles and the weaving band(s) 2', 2" connected therewith are extending in opposite directing with respect to each other; subsequently the hair piece is positioned in close vicinity of the basic hair, whereby the hair bundles remain in their opposed extending position, as shown in FIG. 3 and FIG. 6;

then a number of basic hairs (knot of hair) 9, 9' is conducted through a connection opening 4, 31 of the hair piece 1, e.g. by means of crochet hook 10; as shown in FIG. 6. Subsequently a second knot of basic hair 9" is conducted through a nearby connection opening 4, 31;

after that the passed through knots of basic hair 9', 9" are connected to each other e.g. by means of other means like a clamping element 13; as shown in FIG. 3; aforesaid steps are repeated for other connection openings in or between the weaving bands until the hair piece is sufficiently fixedly connected with the basic hair; finally the hair piece is partially folded up, as shown in FIG. 4; and subsequently completely folded up as shown in FIG. 5.

The invention claimed is:

1. A hair piece for connection with basic hair comprising:

a plurality of hair bundles each comprising a number of parallel hairs, each hair bundle having a free and an upper end, an elongated weaving band comprising two elongated strips, wherein each strip is connected to the upper end of one or more hair bundles, wherein each strip further comprises one or more weaving elements, and wherein hairs of the one or more hair bundles are interconnected individually or in groups with the weaving elements of the strips, connection openings configured to accept basic hair, and connection elements connecting the two strips provided at regular intervals along the weaving band, wherein the hair piece is configurable into a folded configuration and an unfolded configuration, wherein the hair piece is folded along the weaving band so as to overlay the elongated strips with each other in the folded configuration, wherein the free ends of the hair bundles extend in the same direction with respect to each other when the hair piece is in the folded configuration, and wherein the free ends of the hair bundles extend in opposite directions with respect to each other when the hair piece is in the unfolded configuration.

2. The hair piece according to claim 1, wherein the connection openings are provided between the connection elements.

3. The hair piece according to claim 2, wherein the connection openings are formed by strip loops or by joined weaving elements.

4. The hair piece according to claim 1, wherein the connection openings are formed by free space which is present between the connected strips.

5. The hair piece according to claim 1, wherein the strips of the hair bundles are interconnected by means of connection elements provided transversely at a regular distance.

6. The hair piece according to claim 1, characterized in that upper sides of the strips are transversely abuttingly positioned with respect to each other.

7. The hair piece according to claim 1, wherein two connection elements are repeatedly provided at a short distance with respect to each other.

8. The hair piece according to claim 1, wherein the hair bundles comprise small groups of hairs provided with interspaces having little or no hair.

9. The hair piece according to claim 1, wherein the weaving elements are made from hair, cotton or synthetic material.

10. A hair piece comprising at least a first hair bundle and a second hair bundle, each hair bundle comprising a number of parallel hairs and having a free end and an upper end, the first and second hair bundles being attached to opposite edges of an elongated weaving band, said elongated weaving band comprising a first strip and a second strip which are parallel to each other, said elongated weaving band being configured such that the first strip folds over the second strip to conceal at least one interconnecting knot of basic hair such that the free ends of all the hair bundles extend downward after hair piece installation, and connection openings for basic hair are provided between the two parallel strips.

11. A method for attaching into basic hair a hair piece, said hair piece comprising at least a first hair bundle and a second hair bundle, each hair bundle comprising a number of parallel hairs and having a free end and an upper end, the first and second hair bundles being attached to opposite edges of an elongated weaving band, said elongated weaving band comprising one or more strips, the method comprising the following steps:

a) unfolding the hair piece in a substantially flat plane in such a way that the free ends of the hair bundles are extending in opposite directions with respect to each other, b) positioning the weaving band in close proximity to the basic hair, such that the hair bundles remain extended in opposite directions, c) passing at least one time a number of basic hairs through a connection opening of the hair piece, d) interconnecting the passed through basic hairs with the weaving band or with other basic hair, e) repeating the steps c) through d) for another connection opening located in the weaving band until the hair piece is sufficiently fixedly connected with the basic hair along the length of the weaving band.

12. The method for attaching a hair piece according to claim 11, wherein step d) further hairs comprises the following steps:

positioning an adhesion piece onto the basic hairs, and fixedly interconnecting the adhesion piece with the hairs.

13. The method according to claim 12, wherein the adhesion piece is attached onto the basic hair by means of a thin sheet-shaped hull, positioned at a distance of about 2-3 cm. from the weaving band.

* * * * *